US012276428B2

(12) United States Patent
Oji et al.

(10) Patent No.: US 12,276,428 B2
(45) Date of Patent: Apr. 15, 2025

(54) INDOOR UNIT IN AIR CONDITIONER

(71) Applicant: DAIKIN INDUSTRIES, LTD., Osaka (JP)

(72) Inventors: Kana Oji, Osaka (JP); Wataru Fukushima, Osaka (JP); Toshimichi Nakayama, Osaka (JP); Ryota Suhara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/441,251

(22) Filed: Feb. 14, 2024

(65) Prior Publication Data

US 2024/0183545 A1 Jun. 6, 2024

Related U.S. Application Data

(63) Continuation of application No. PCT/JP2022/022282, filed on Jun. 1, 2022.

(30) Foreign Application Priority Data

Aug. 24, 2021 (JP) ..... 2021-136179

(51) Int. Cl.
*F24F 1/0011* (2019.01)
*F24F 1/0071* (2019.01)
(Continued)

(52) U.S. Cl.
CPC ..... *F24F 1/0011* (2013.01); *F24F 1/0071* (2019.02); *F24F 8/22* (2021.01);
(Continued)

(58) Field of Classification Search
CPC ..... F24F 1/0011; F24F 1/0071; F24F 1/0073; F24F 8/20; F24F 8/22; F24F 8/26
See application file for complete search history.

(56) References Cited

U.S. PATENT DOCUMENTS

2002/0168305 A1 11/2002 Morrow et al.
2003/0206840 A1* 11/2003 Taylor ..... A61L 9/015 422/186.04
(Continued)

FOREIGN PATENT DOCUMENTS

CN 111059632 A 4/2020
CN 111811057 A 10/2020
(Continued)

OTHER PUBLICATIONS

English translation of the International Search Report issued in corresponding International Application No. PCT/JP2022/022282, dated Aug. 16, 2022 (2 pages).
(Continued)

*Primary Examiner* — Steven B Mcallister
*Assistant Examiner* — Charles R Brawner
(74) *Attorney, Agent, or Firm* — Osha Bergman Watanabe & Burton LLP

(57) ABSTRACT

An indoor unit in an air conditioner configured to condition air in an indoor space includes: a casing that includes an intake port opened downward toward the indoor space; a fan configured to suck air in the indoor space into the casing via the intake port; a collector configured to collect dust contained in the air sucked via the intake port; a light source configured to irradiate an upstream side of the collector in an air flow direction with ultraviolet rays; a shield configured to block the ultraviolet rays from the light source toward the intake port; and a protecting member having a mesh shape and covering the intake port at a position upstream of the collector in the air flow direction.

2 Claims, 16 Drawing Sheets

(51) Int. Cl.

| | |
|---|---|
| ***F24F 1/0073*** | (2019.01) |
| ***F24F 8/20*** | (2021.01) |
| ***F24F 8/22*** | (2021.01) |
| ***F24F 8/26*** | (2021.01) |

(52) U.S. Cl.
CPC ..... *F24F 1/0073* (2019.02); *F24F 8/20* (2021.01); *F24F 8/26* (2021.01)

(56) References Cited

U.S. PATENT DOCUMENTS

| | | | | |
|---|---|---|---|---|
| 2006/0057020 | A1* | 3/2006 | Tufo | F24F 8/22 422/24 |
| 2013/0291735 | A1 | 11/2013 | Livchak et al. | |
| 2015/0352242 | A1* | 12/2015 | Ando | A61L 9/12 422/122 |
| 2017/0128613 | A1* | 5/2017 | Stewart | A61L 9/20 |
| 2020/0017290 | A1* | 1/2020 | Bjerg | B65D 88/741 |
| 2020/0063983 | A1* | 2/2020 | Iwase | F24F 1/0047 |
| 2021/0317981 | A1* | 10/2021 | Higgins | F21V 3/00 |
| 2021/0396408 | A1* | 12/2021 | Saieva | F24F 1/0076 |
| 2022/0176287 | A1* | 6/2022 | Yang | B01D 46/0028 |
| 2022/0404045 | A1* | 12/2022 | Park | A61L 9/20 |
| 2023/0073141 | A1* | 3/2023 | Dunberger | F24F 8/90 |

FOREIGN PATENT DOCUMENTS

| | | | |
|---|---|---|---|
| JP | H09276629 | A | 10/1997 |
| JP | 2005055114 | A | 3/2005 |
| JP | 2005351536 | A | 12/2005 |
| JP | 2019035517 | A | 3/2019 |

OTHER PUBLICATIONS

Decision to Grant a Patent issued in corresponding Japanese Patent Application No. 2021-136179, dated Mar. 7, 2023, with translation (5 pages).

Notice of Reasons for Refusal issued in corresponding Japanese Patent Application No. 2021-136179, dated Aug. 23, 2022, with translation (9 pages).

International Preliminary Report on Patentability issued in corresponding International Application No. PCT/JP2022/022282, issued Feb. 27, 2024 (5 pages).

* cited by examiner

INDOOR UNIT IN AIR CONDITIONER

TECHNICAL FIELD

The present disclosure relates to an indoor unit in an air conditioner.

BACKGROUND

Conventionally, there has been widely used an indoor unit (of a so-called cassette type) including a downward intake port in an air conditioner configured to condition air in an indoor space of an office building or the like. Such an indoor unit includes a collecting member (filter) configured to collect dust contained in air sucked into a casing. The dust collected by the collecting member contains bacteria and the like, and the collecting member having collected such dust generates injurious ingredients and odorous components. There has recently been developed an indoor unit having a function of cleaning (debacterializing) the interior of a casing (see PATENT LITERATURE 1). The indoor unit included in an air conditioner according to PATENT LITERATURE 1 includes an electric discharger unit (activated species generator) configured to generate activated species. The indoor unit drives the electric discharger unit to supply activated species around a heat exchanger, a drain pan, and the like provided in the indoor unit to decompose injurious ingredients and odorous components in the indoor unit for cleaning (debacterializing) in the indoor unit.

PATENT LITERATURE

PATENT LITERATURE 1: Japanese Laid-Open Patent Publication No. 2019-SUMMARY

An indoor unit in an air conditioner according to the present disclosure is configured to condition air in an indoor space, and the indoor unit includes: a casing provided with an intake port opened downward toward the indoor space; a fan configured to suck air in the indoor space into the casing via the intake port; a first collecting member configured to collect dust contained in the air sucked via the intake port; a light source configured to irradiate an upstream side of the first collecting member in an air flow direction with ultraviolet rays; and a blocking member configured to block ultraviolet rays from the light source toward the intake port.

DETAILED DESCRIPTION (Outline of Air Conditioner)

Figure 1:
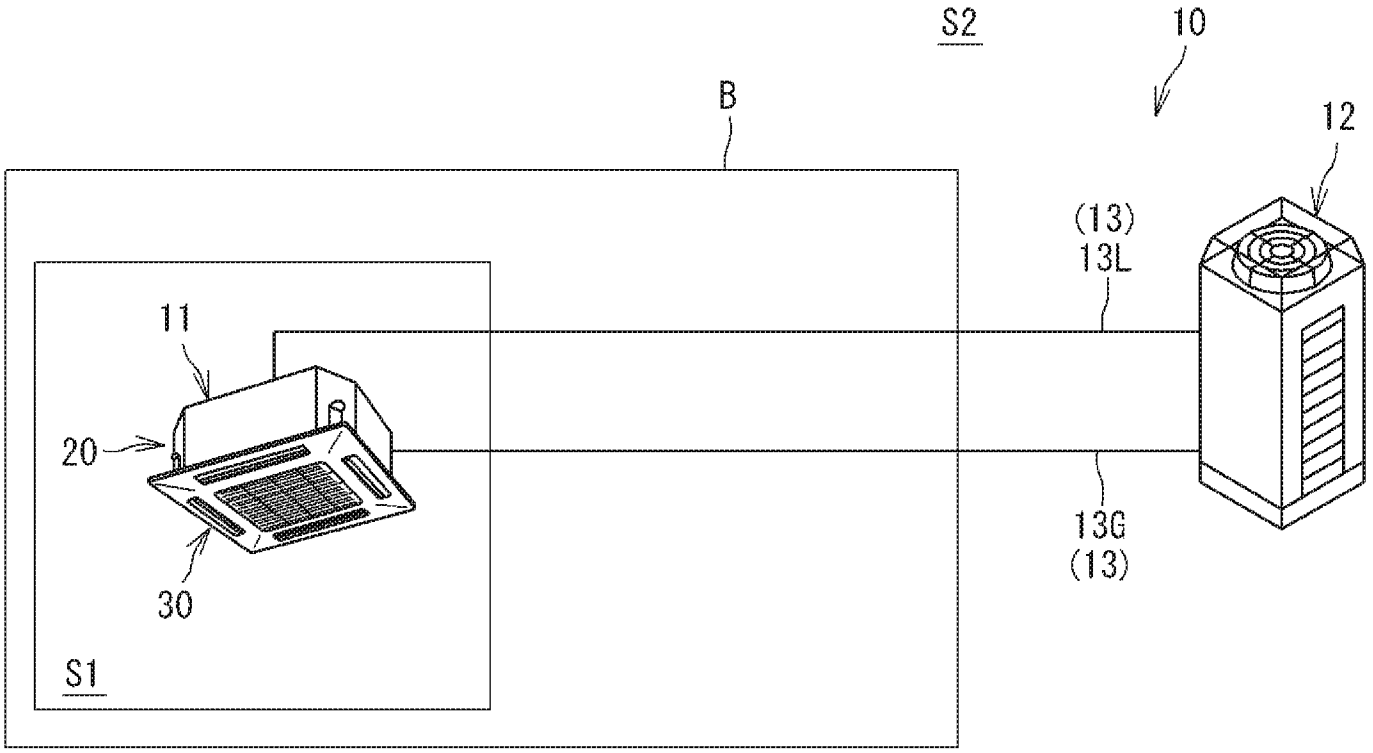
FIG. 1 is a schematic configuration diagram of an air conditioner including an indoor unit according to the present disclosure.

FIG. 1 is a schematic configuration diagram of an air conditioner including an indoor unit according to the present disclosure. FIG. 1 depicts an air conditioner 10 configured to achieve a vapor compression refrigeration cycle to cool and heat an indoor space S1 provided in a building B. The air conditioner 10 includes an indoor unit 11 exemplifying the indoor unit in the air conditioner according to the present disclosure. The air conditioner 10 further includes an outdoor unit 12 and a refrigerant pipe 13. The refrigerant pipe 13 includes a liquid tube 13L and a gas tube 13G. The air conditioner 10 includes a refrigerant circuit constituted by connecting the indoor unit 11 and the outdoor unit 12 via the refrigerant pipe 13. The indoor unit 11 is disposed in the indoor space S1 whereas the outdoor unit 12 is disposed in an outdoor space S2. The outdoor space S2 in this description also includes a space outside the indoor space S1 in the building B, while the outdoor unit 12 according to one or more embodiments is disposed outside the building B in the outdoor space S2. In the air conditioner 10 depicted in FIG. 1, the single indoor unit 11 is connected to the single outdoor unit 12. Alternatively, a plurality of indoor units 11 may be connected to the single outdoor unit 12. The present embodiments exemplify the air conditioner 10 configured to circulate a refrigerant in the refrigerant circuit to execute cooling operation and heating operation. The air conditioner including the indoor unit according to the present disclosure should not be limited to such a case, and may alternatively be configured to circulate cold water and warm water supplied from a heat source device to execute cooling operation and heating operation, and the indoor unit may be a so-called fan coil unit.

(Configuration of Indoor Unit)

Figure 2:
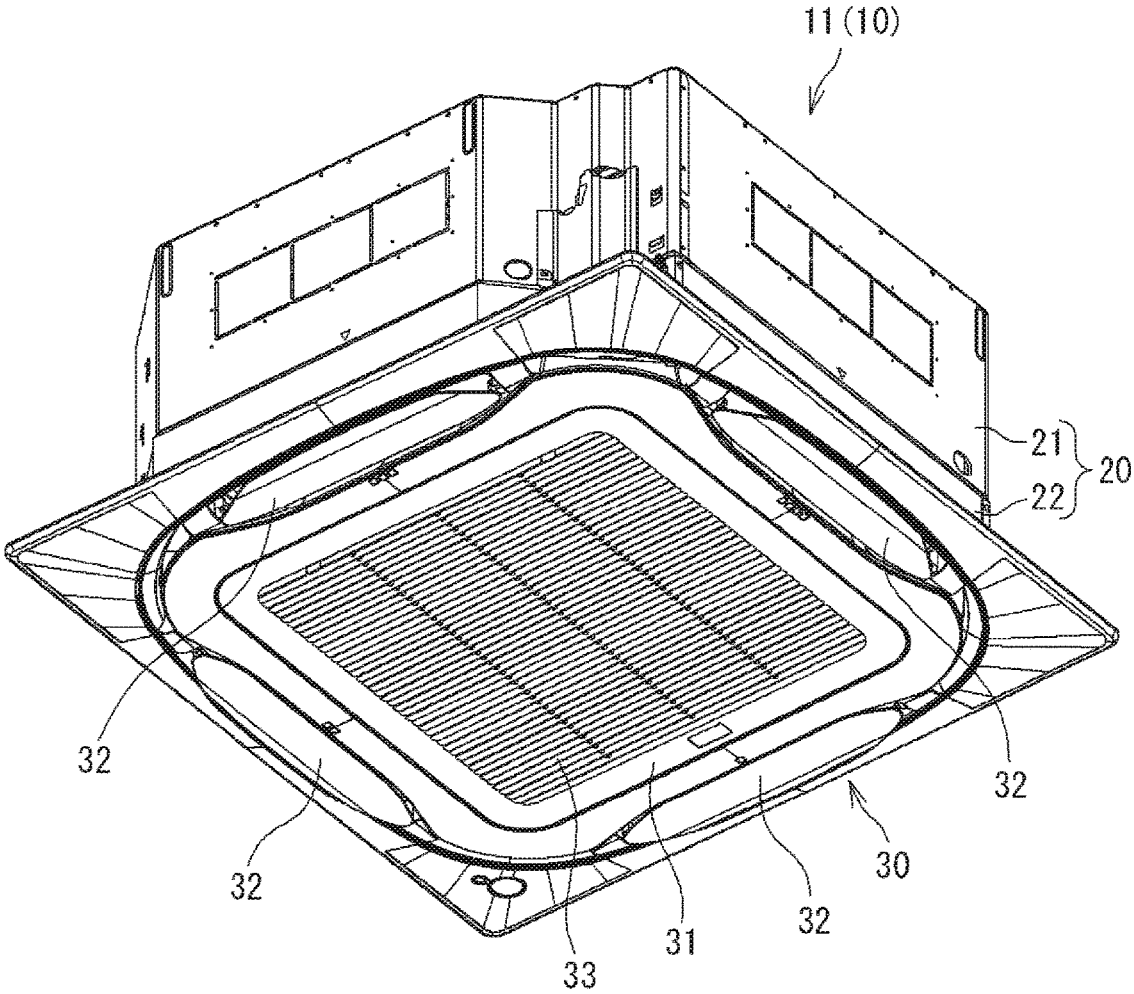
FIG. 2 is a perspective view of the indoor unit in the air conditioner according to the present disclosure.
Figure 3:
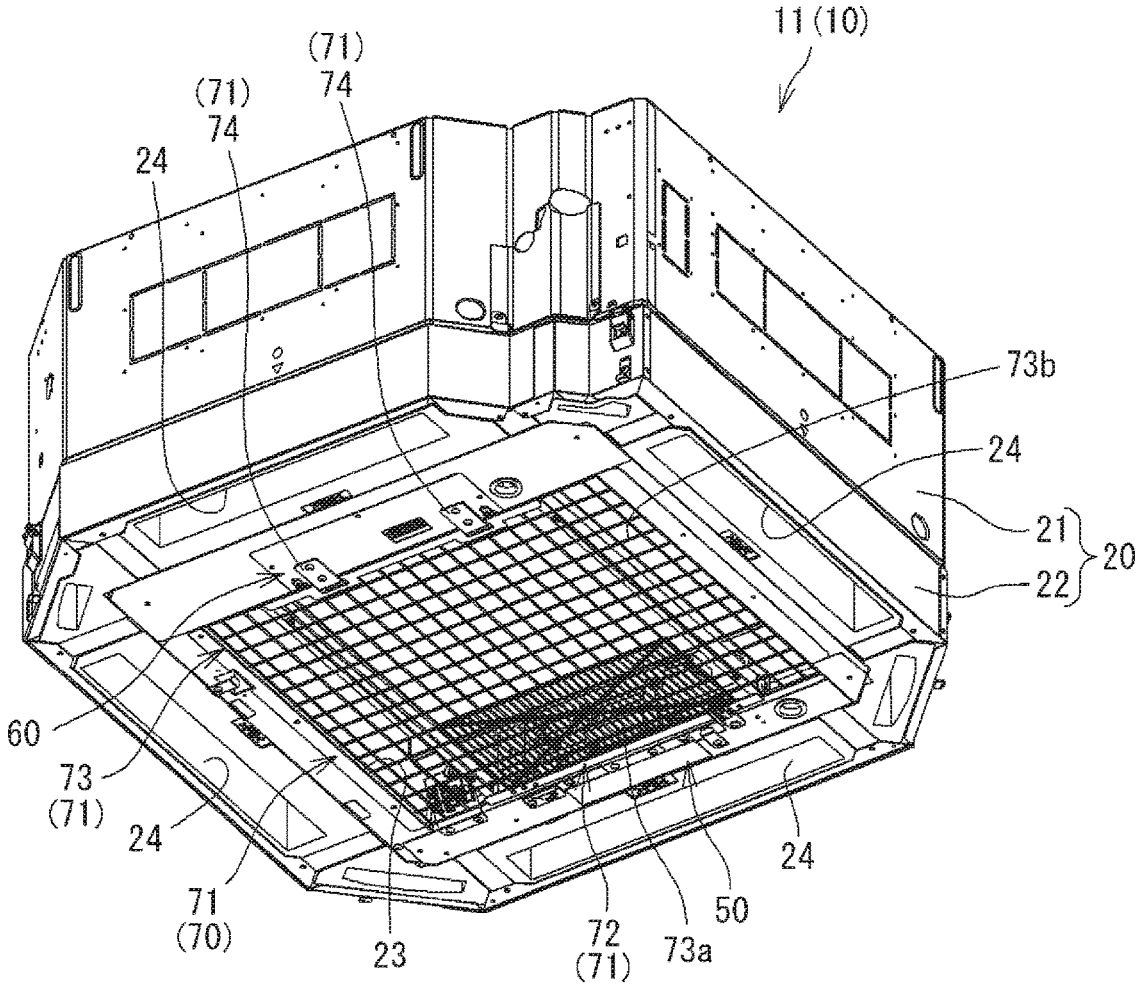
FIG. 3 is a perspective view of the indoor unit with a decorative panel being detached.
Figure 4:
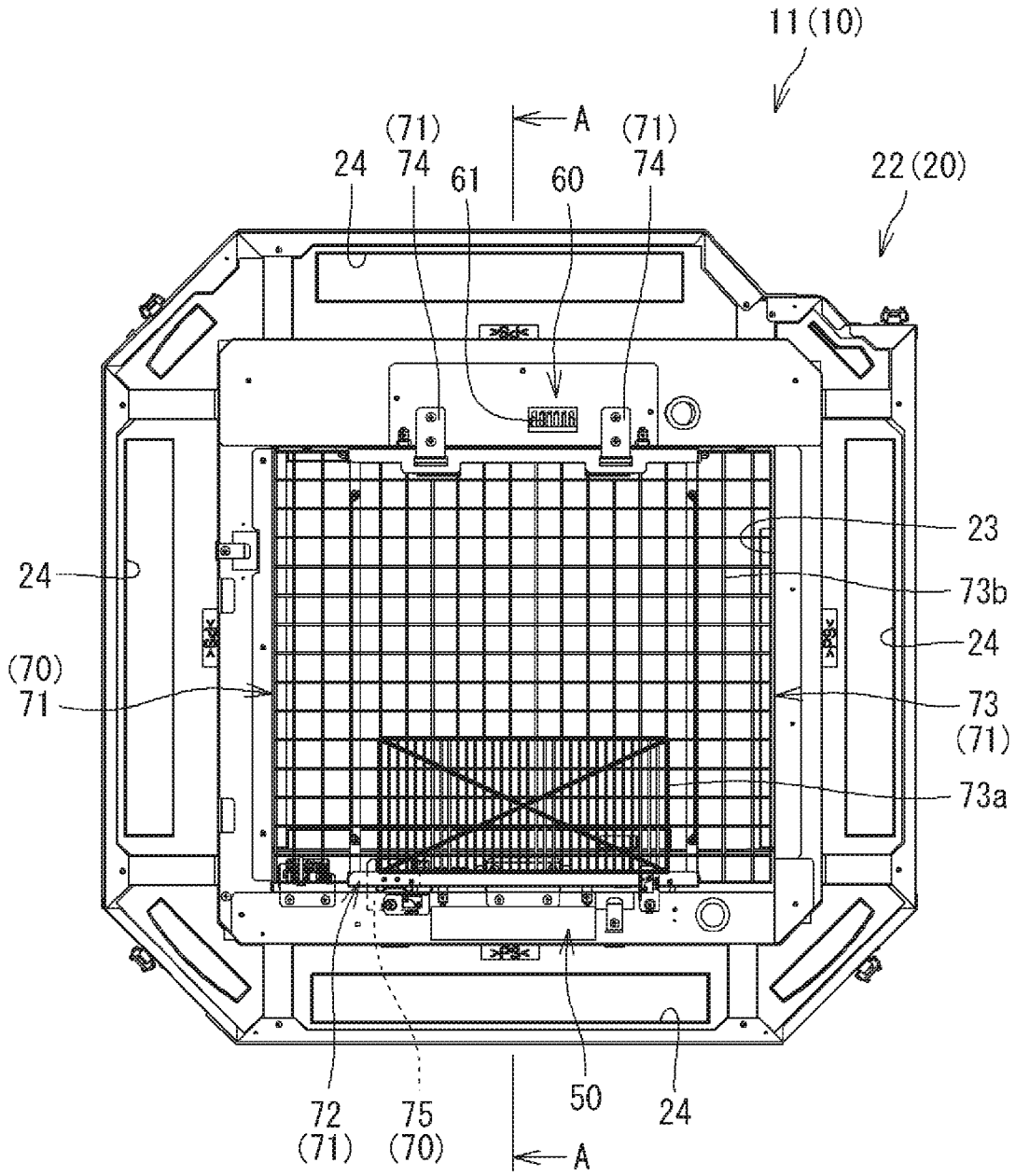
FIG. 4 is a bottom view of the indoor unit with the decorative panel being detached.
Figure 5:
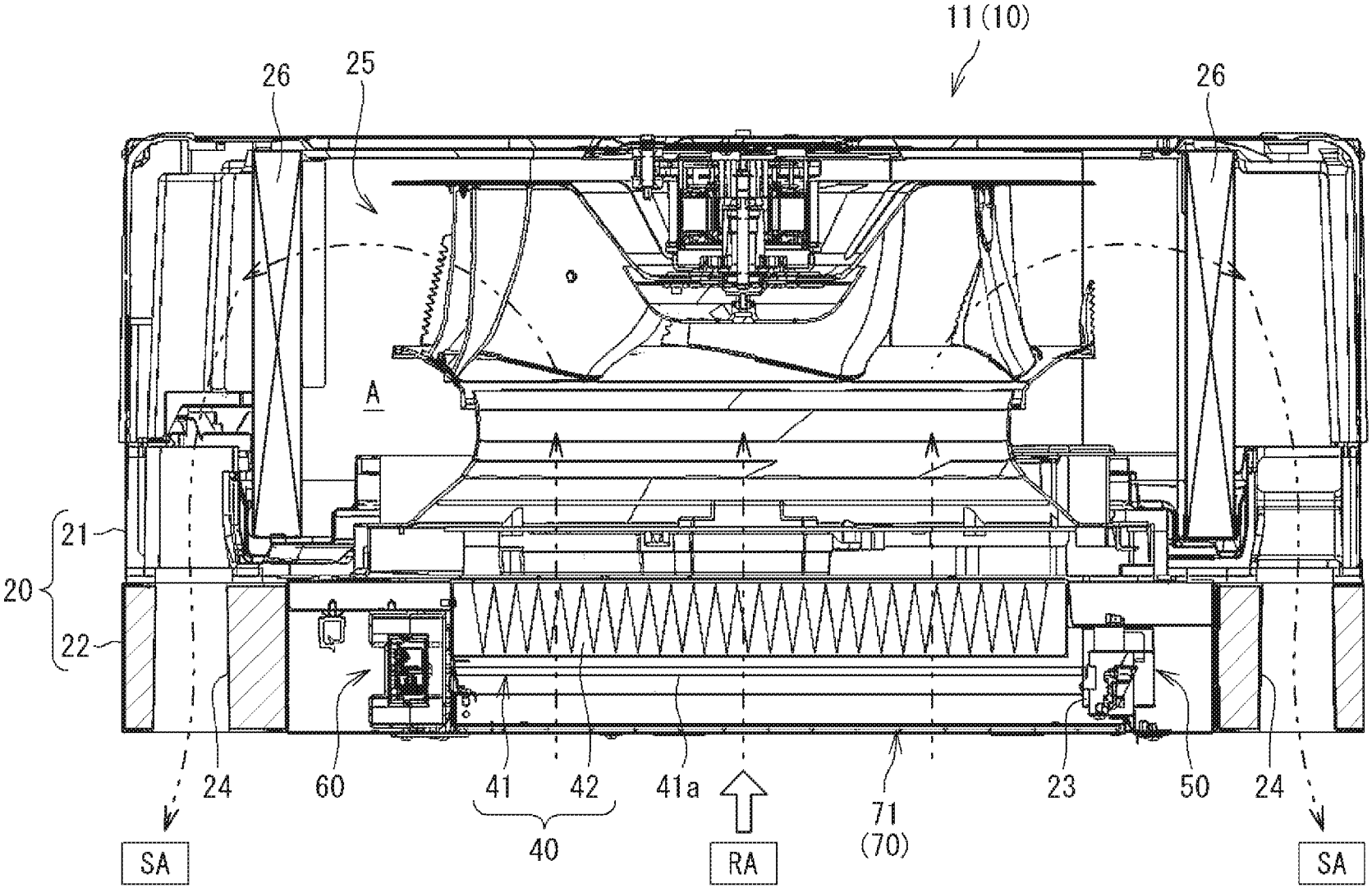
FIG. 5 is a sectional view taken along line A-A indicated in FIG. 4.

FIG. 2 is a perspective view of the indoor unit in the air conditioner according to the present disclosure. FIG. 3 is a perspective view of the indoor unit with a decorative panel being detached. FIG. 4 is a bottom view of the indoor unit with the decorative panel being detached. FIG. 5 is a sectional view taken along line A-A indicated in FIG. 4. As depicted in FIG. 1 and FIG. 2, the indoor unit 11 is of a so-called cassette type, and includes a casing 20 and a decorative panel 30.

As depicted in FIG. 3 and FIG. 4, the casing 20 has a substantially rectangular shape in a bottom view, and includes a first casing 21 disposed in an upper portion and a second casing 22 disposed in a lower portion. As depicted in FIG. 5, the casing 20 is provided therein with a space A accommodating an indoor fan 25, a heat exchanger 26, a collecting member (i.e., collector) 40, an ultraviolet ray irradiator 50, an activated species generator 60, and the like, which will be described later. The space A also serves as an air flow path in the casing 20. As depicted in FIG. 3 and FIG. 4, the casing 20 has a lower end portion provided with an intake port 23 positioned at a center portion of the rectangular shape, and four air supply ports 24 surrounding the intake port 23. The intake port 23 and the air supply ports 24 are openings provided at a lower end of the space A (see FIG. 5). The intake port 23 is provided with a protecting member 71 to be described later. In the indoor unit 11 in a normal use state, the second casing 22 has a lower end portion covered with the decorative panel 30 (see FIG. 2).

As depicted in FIG. 2, the decorative panel 30 has a substantially rectangular shape in a bottom view, and includes an intake grill 31 disposed in a center portion of the rectangular shape, and four blow-out ports 32 surrounding the intake grill 31. The intake grill 31 is provided with an opening 33 having a slit shape. The opening 33 is in communication with the space A (see FIG. 5) via the intake port 23 (see FIG. 3). The blow-out ports 32 of the decorative panel 30 are in communication with the space A (see FIG. 5) via the air supply ports 24 (see FIG. 3). The indoor unit 11 sucks air in the indoor space S1 (see FIG. 1) into the casing 20 via the intake grill 31 and the intake port 23, and supplies the indoor space S1 with the air sucked into the casing 20 via the air supply ports 24 and the blow-out ports 32.

As depicted in FIG. 5, the indoor unit 11 includes the indoor fan 25 and the heat exchanger 26 accommodated in the casing 20 (the space A). The indoor fan 25 is configured to circulate air in the indoor space S1. The heat exchanger 26 constitutes part of the refrigerant circuit, and the refrigerant pipe 13 allows refrigerant circulation to and from the outdoor unit 12. The indoor unit 11 drives the indoor fan 25 to cause air (return air RA) in the indoor space S1 to be sucked in to the casing 20 via the intake grill 31 (see FIG. 2) and the intake port 23 and pass the heat exchanger 26, and cause cooled or heated air (supply air SA) to be supplied to the indoor space S1 via the air supply ports 24 and the blow-out ports 32 (see FIG. 2).

(Collecting Member)

Figure 6:
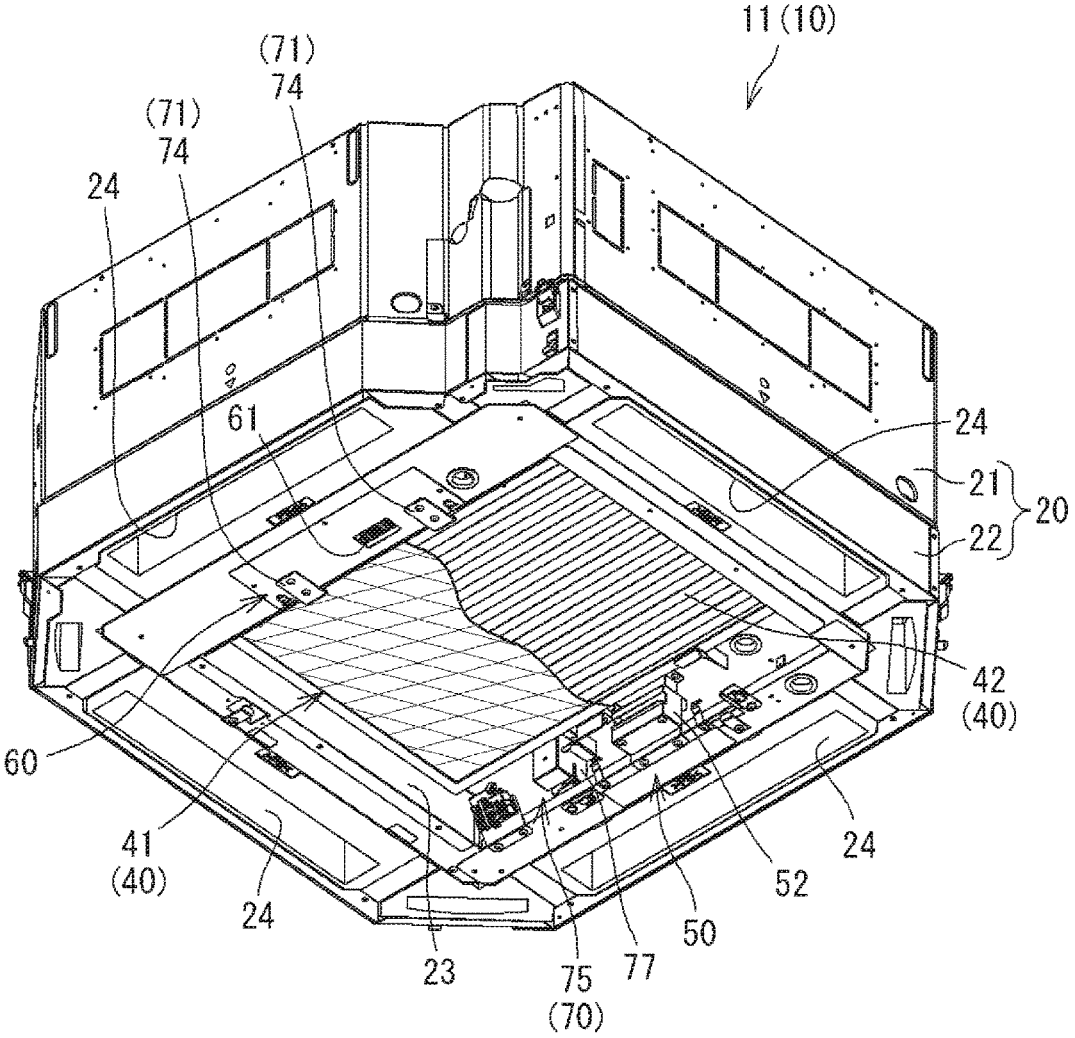
FIG. 6 is a perspective view of the indoor unit with the decorative panel and a protecting member being detached.
Figure 7:
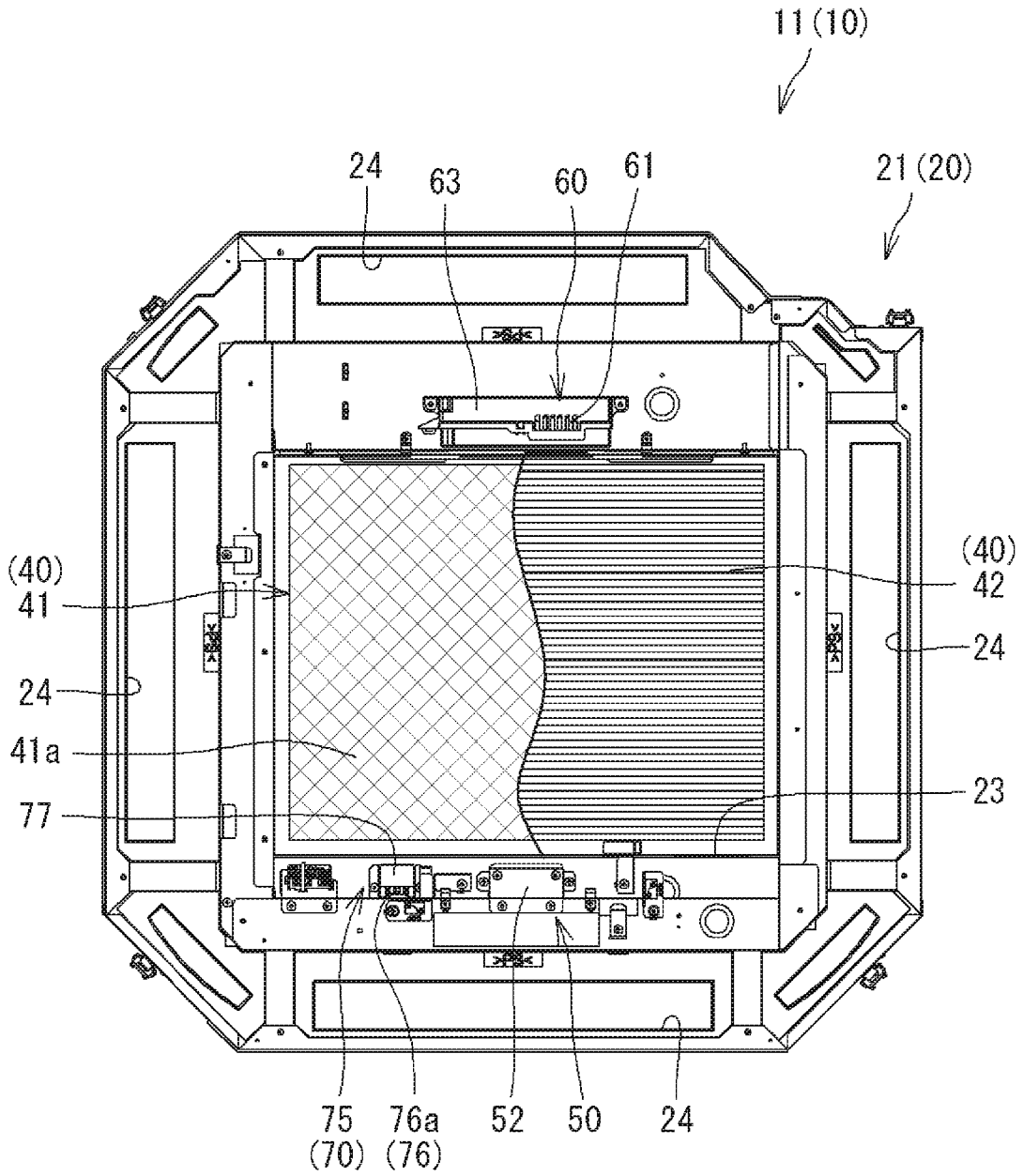
FIG. 7 is a bottom view of the indoor unit with the decorative panel and the protecting member being detached.
Figure 8:
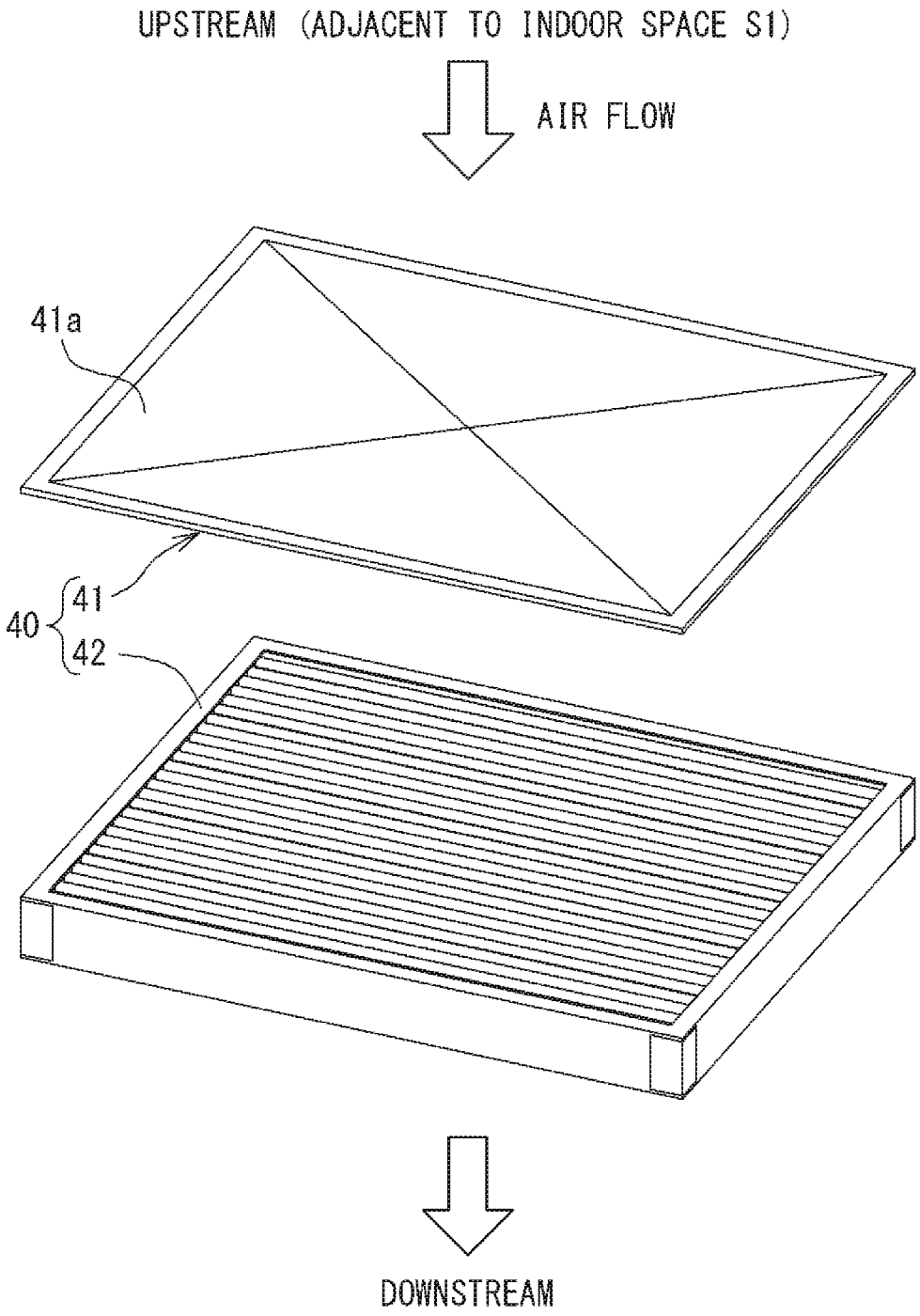
FIG. 8 is a perspective pattern view of a first filter and a second filter.

FIG. 6 is a perspective view of the indoor unit with the decorative panel and the protecting member being detached. FIG. 7 is a bottom view of the indoor unit with the decorative panel and the protecting member being detached. FIG. 8 is a perspective pattern view of the collecting member. As depicted in FIG. 6 and FIG. 7, the indoor unit 11 includes the collecting member 40 accommodated in the casing 20. The collecting member 40 is configured to collect dust contained in the air (return air RA) in the indoor space S1. As depicted in FIG. 8, the collecting member 40 includes a first filter 41 as a first collecting member 40, and a second filter 42 as a second collecting member 40. The second filter 42 is configured to collect (finer) dust that cannot be perfectly collected by the first filter 41, and has finer mesh and higher collection efficiency (about 60% to 95%) in comparison to the first filter 41. In other words, the first filter 41 has coarser mesh in comparison to the second filter 42. The present embodiments exemplify the case where the second collecting member 40 is a filter. The second collecting member may alternatively be an electric dust collector.

As depicted in FIG. 5, the first filter 41 is disposed upstream of the second filter 42 in an air flow direction. The first filter 41 has an upstream surface in the air flow direction, and the upstream surface will be referred to as a first surface 41*a* in the following description. The first surface 41*a* of the first filter 41 is a planar surface. The "planar surface" herein indicates that the surface has no unevenness (pleats) and has no shade when irradiated with oblique light with respect to the surface. The collecting member 40 according to one or more embodiments includes the first filter 41 and the second filter 42. The collecting member in the indoor unit according to the present disclosure may alternatively include only the first filter. In the indoor unit 11, the air (return air RA) sucked into the casing 20 via the intake grill 31 (see FIG. 2) and the intake port 23 passes the collecting member 40. The first filter 41 and the second filter 42 collect dust contained in the return air RA. In the indoor unit 11, dust generating injurious ingredients and odorous components adheres to the first surface 41*a* of the first filter 41.

(Ultraviolet Ray Irradiator)

Figure 9:
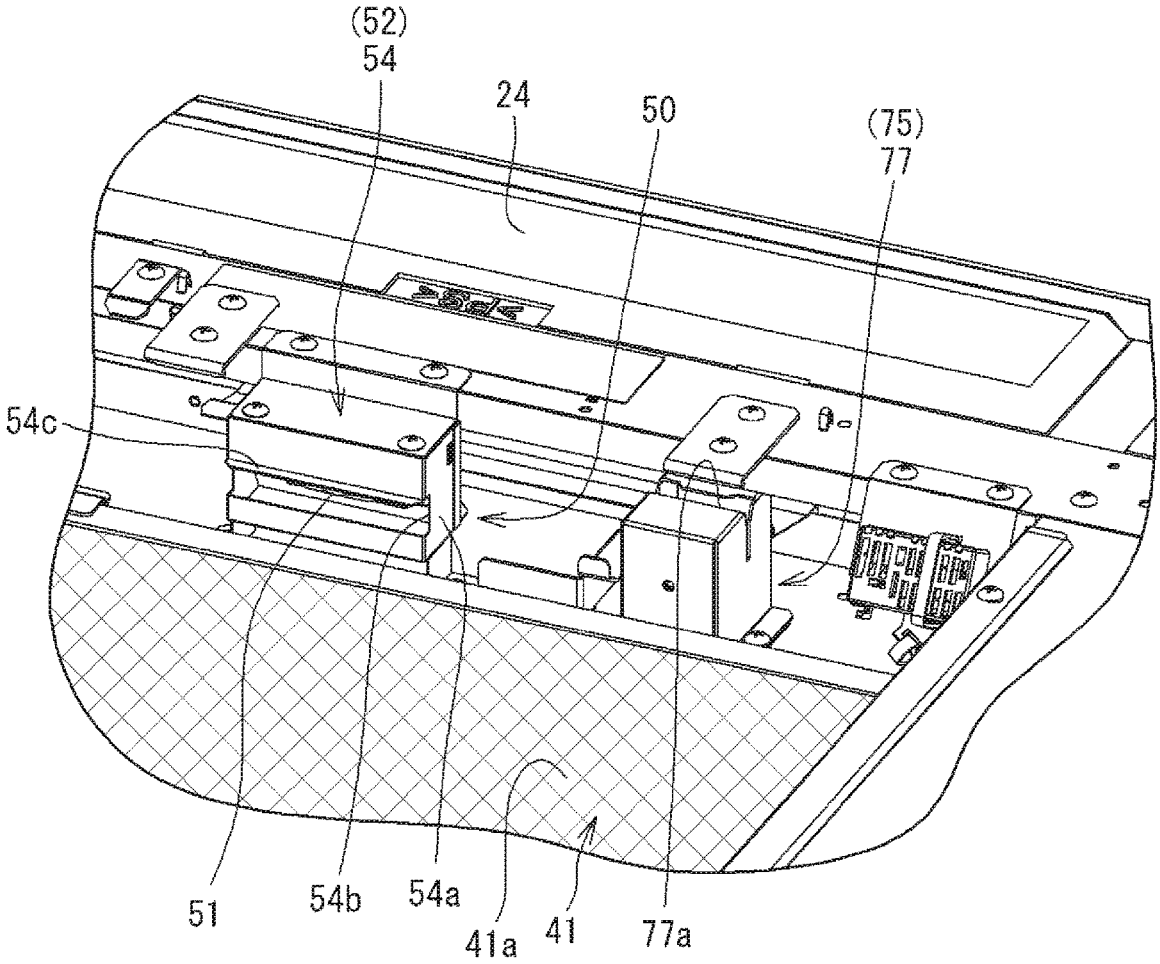
FIG. 9 is a partially enlarged perspective view of an ultraviolet ray irradiator and a limit switch.
Figure 10:
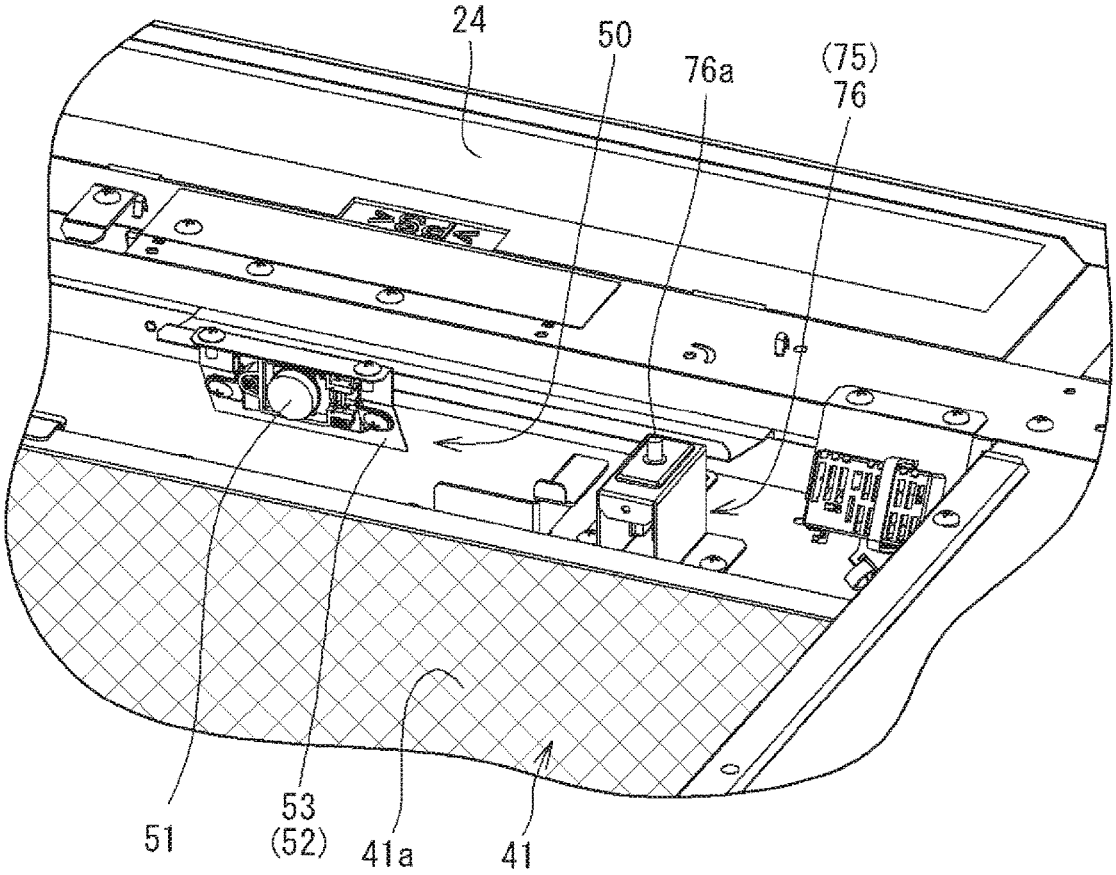
FIG. 10 is a partially enlarged perspective view of the ultraviolet ray irradiator with a blocking member (second member) being detached and the limit switch with a protecting cover being detached.
Figure 11:
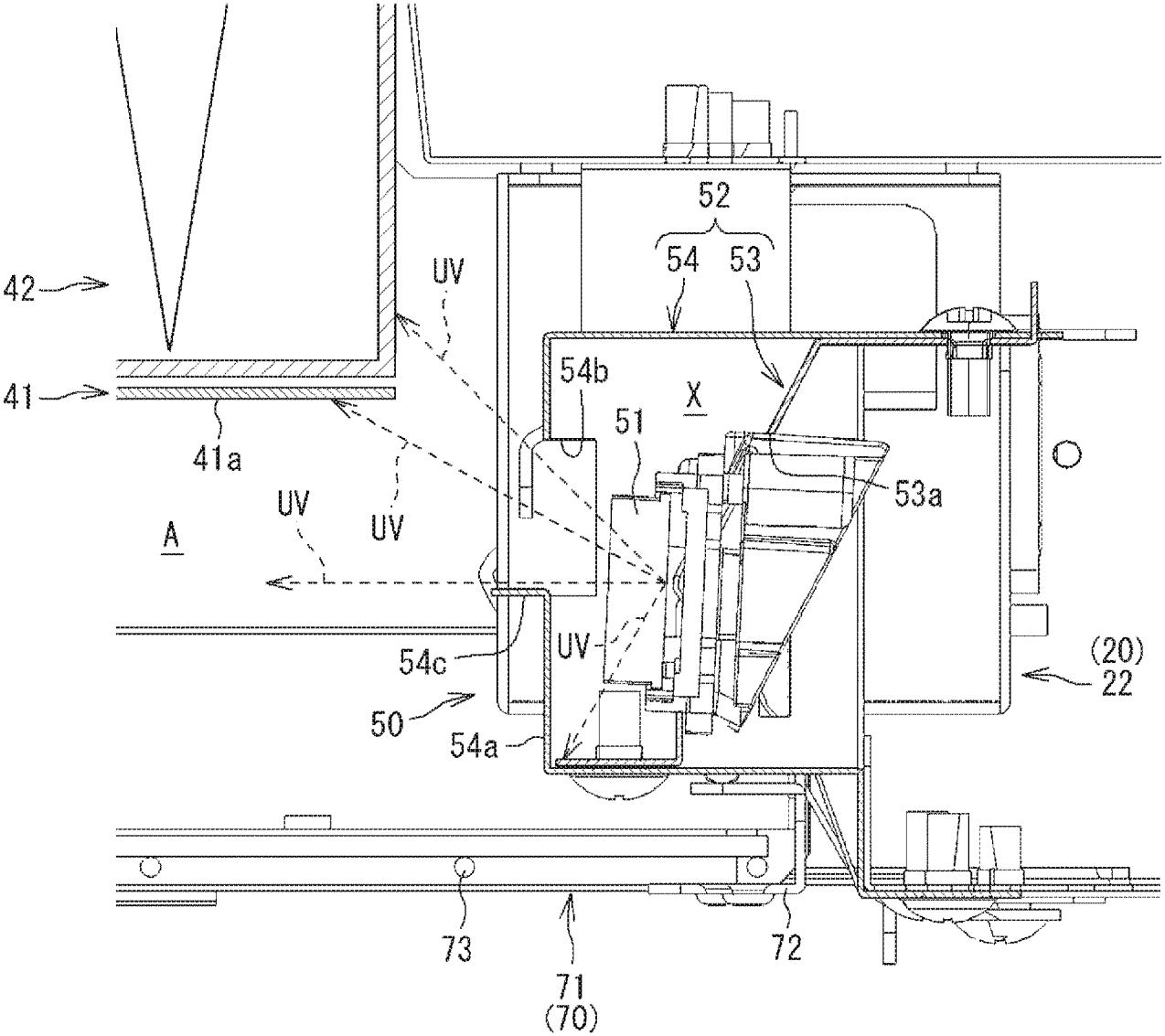
FIG. 11 is a schematic partial sectional view indicating an ultraviolet ray irradiating situation of the ultraviolet ray irradiator.
Figure 12:
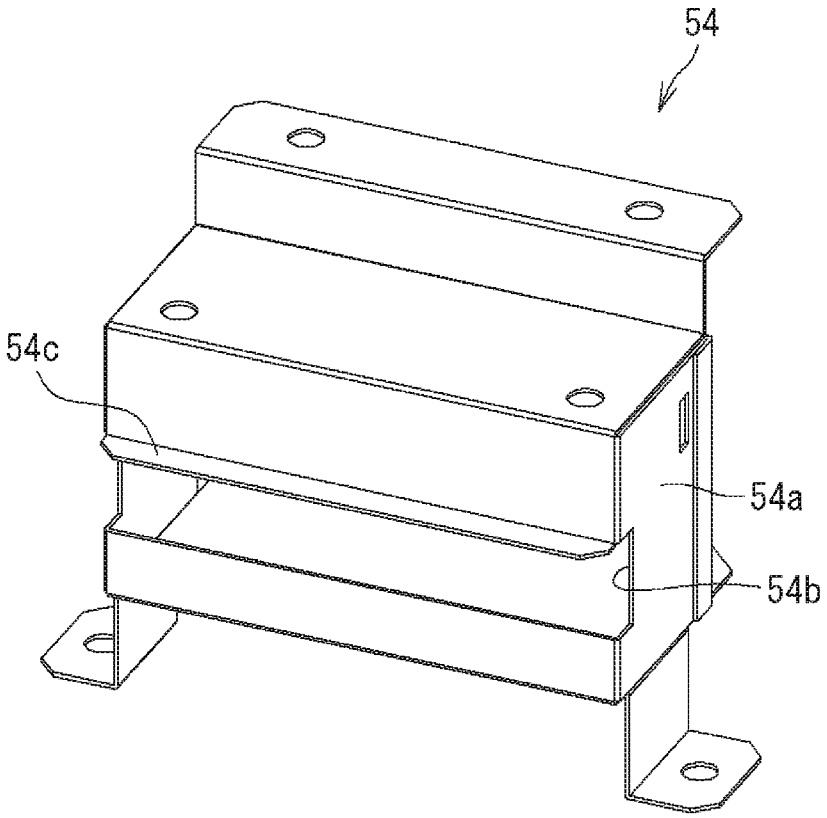
FIG. 12 is a perspective view of the blocking member (second member).

FIG. 9 is a partially enlarged perspective view of the ultraviolet ray irradiator and a limit switch. FIG. 10 is a partially enlarged perspective view of the ultraviolet ray irradiator with a blocking member (second member, shield) being detached and the limit switch with a protecting cover being detached. FIG. 11 is a schematic partial sectional view indicating an ultraviolet ray irradiating situation of the ultraviolet ray irradiator. FIG. 12 is a perspective view of the blocking member (second member). As depicted in FIG. 5 to FIG. 7, FIG. 9, and FIG. 10, the indoor unit 11 includes the ultraviolet ray irradiator 50. The ultraviolet ray irradiator 50 is configured to irradiate the first surface 41*a* of the first filter 41 with ultraviolet rays, and includes a light source 51 and a blocking member 52. The light source 51 includes an LED device configured to generate ultraviolet rays when electrified. The light source 51 is equipped with a lens (not depicted) configured to diffuse ultraviolet rays generated by the light source 51 substantially entirely on the first surface 41*a*. The light source 51 according to one or more embodiments is fixed to the casing 20 and irradiates the first surface 41*a* with ultraviolet rays from a fixed position. Alternatively, the light source 51 may further include a displacement mechanism configured to displace the light source 51 with respect to the casing 20, and may be configured to irradiate the first surface 41*a* with ultraviolet rays while being displaced by the displacement mechanism.

As depicted in FIG. 5, the ultraviolet ray irradiator 50 is disposed at a position deviated from an air flow from the intake port 23 toward the collecting member 40. In other words, the ultraviolet ray irradiator 50 is positioned not to be overlapped with the intake port 23 and the collecting member 40 in a bottom view. If the ultraviolet ray irradiator 50 is disposed in the air flow from the intake port 23 toward the collecting member 40, the ultraviolet ray irradiator 50 will increase air flow resistance. In the indoor unit 11 according to the present disclosure, the ultraviolet ray irradiator 50 is disposed at a position deviated from the air flow from the intake port 23 toward the collecting member 40 in order to inhibit increase in air flow resistance.

(Blocking Member)

As depicted in FIG. 6, FIG. 7, and FIG. 9 to FIG. 11, the ultraviolet ray irradiator 50 includes the blocking member 52. The blocking member 52 is configured to restrict an irradiation range of ultraviolet rays from the light source 51.

As depicted in FIG. 9 to FIG. 11, the blocking member 52 is constituted by a first member 53 supporting the light source 51 from the casing 20, and a second member 54 covering the light source 51 supported by the first member 53. The blocking member 52 also serves as a member supporting the light source 51 with respect to the casing 20, and is screwed to the casing 20. The first member 53 and the second member 54 are each made of metal, and are combined to constitute the integrated blocking member 52. The blocking member 52 may alternatively be made of a material (e.g. resin) other than metal.

As depicted in FIG. 11, the first member 53 has an opening 53*a* provided for disposition of the light source 51. The light source 51 fitted in the opening 53*a* is screwed to the first member 53.

As depicted in FIG. 9, FIG. 11, and FIG. 12, the second member 54 includes a body 54*a* having a box shape. The second member 54 and the first member 53 are used in combination with each other in a state where the first member 53 is disposed inside the body 54*a*. The blocking member 52, which is constituted by the first member 53 and the second member 54 in combination with each other, has a space X surrounded with the body 54*a* and the first member 53. The ultraviolet ray irradiator 50 includes the light source 51 disposed in the space X.

The body 54*a* has an opening 54*b*. As depicted in FIG. 11, the light source 51 in the space X emits ultraviolet rays UV to be applied to the space A outside the blocking member 52 via the opening 54*b*. In other words, the ultraviolet rays UV emitted from the light source 51 in the space X contain ultraviolet rays UV that are directed to a point other than the opening 54*b* and are blocked by the blocking member 52. The body 54*a* further includes a flange 54*c* surrounding the opening 54*b*. The flange 54*c* accordingly blocks part of ultraviolet rays UV directed to the space A via the opening 54*b*.

The body 54*a* and the flange 54*c* in the blocking member 52 are disposed between the light source 51 and the intake port 23, and blocks ultraviolet rays UV toward the intake port 23 in the ultraviolet rays UV from the light source 51 toward the space A. In other words, the opening 54*b* and the flange 54*c* are disposed in the ultraviolet ray irradiator 50 such that the blocking member 52 does not block ultraviolet rays UV from the light source 51 toward the first surface 41*a* of the first filter 41. In a case where the casing 20 has an opening opened to face the indoor space S1 in addition to the intake port 23, the body 54*a* and the flange 54*c* may be disposed also between the opening and the light source 51. The blocking member 52 is not limitedly configured as depicted in the present embodiments. In an exemplary case where the light source 51 is not accommodated in the space X but is exposed in the space A, the blocking member may have a plate shape (without having the space X) and be disposed upstream of the light source 51. In other words, the blocking member according to the present disclosure has only to be configured to inhibit irradiation of the indoor space S1 with ultraviolet rays emitted from the light source 51.

(Activated Species Generator)

Figure 13:
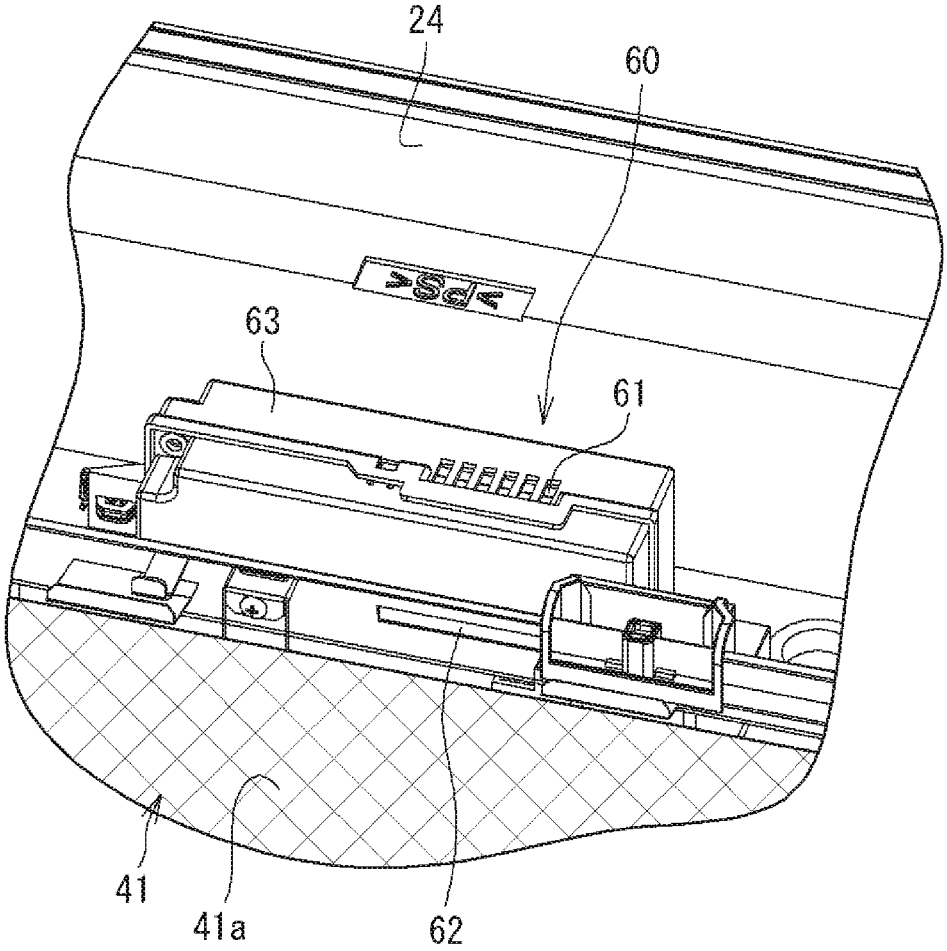
FIG. 13 is a partially enlarged perspective view of an activated species generator.

As depicted in FIG. 6, FIG. 7, and FIG. 13, the indoor unit 11 includes the activated species generator 60. The activated species generator 60 is configured to supply air passing the casing 20 with activated species, and includes a case 63 provided with an intake port 61 and a discharge port 62. The activated species generator 60 has an electric discharger (not depicted) provided in the case 63 and including a needle electrode and a counter electrode. When high voltage is applied to the electric discharger, the electric discharger generates streamer discharge as a type of plasma discharge. The activated species generator 60 generates streamer discharge to generate activated species having high oxidative decomposition capacity. Examples of the activated species generated by the activated species generator 60 include fast electrons, ions, hydroxylic radicals, and excited oxygen molecules, and the activated species decompose injurious ingredients and odorous components contained in the air and constituted by small organic molecules such as ammonium groups, aldehydes, or nitrogen oxides.

The activated species generator 60 imports part of the air in the casing 20 into the case 63 via the intake port 61, and discharges, from the discharge port 62 the activated species generated by the electric discharger along with the air. As depicted in FIG. 13, the intake port 61 and the discharge port 62 are disposed upstream of the first filter 41 in the air flow direction. The activated species generator 60 thus generates activated species at a position upstream of the first filter 41. The indoor unit 11 includes the light source 51 and the activated species generator 60, so as to clean (sterilize) the first surface 41*a* of the first filter 41 with use of ultraviolet rays, and clean the first surface also with use of activated species. The indoor unit 11 accordingly has higher cleaning capacity in the casing 20 in comparison to a conventional indoor unit including only an activated species generator.

As depicted in FIG. 6 and FIG. 7, in the indoor unit 11 according to the present disclosure, the activated species generator 60 is positioned to face the ultraviolet ray irradiator 50 with the intake port 23 and the first filter 41 interposed therebetween. Such a configuration inhibits unevenness in cleaning degree on the first surface 41*a*.

(Protector)

As depicted in FIG. 4, the indoor unit 11 includes a protector 70 configured to protect a user from ultraviolet rays emitted from the ultraviolet ray irradiator 50. The protector 70 includes the protecting member 71 and a limit switch 75.

(Protecting Member)

Figure 14:
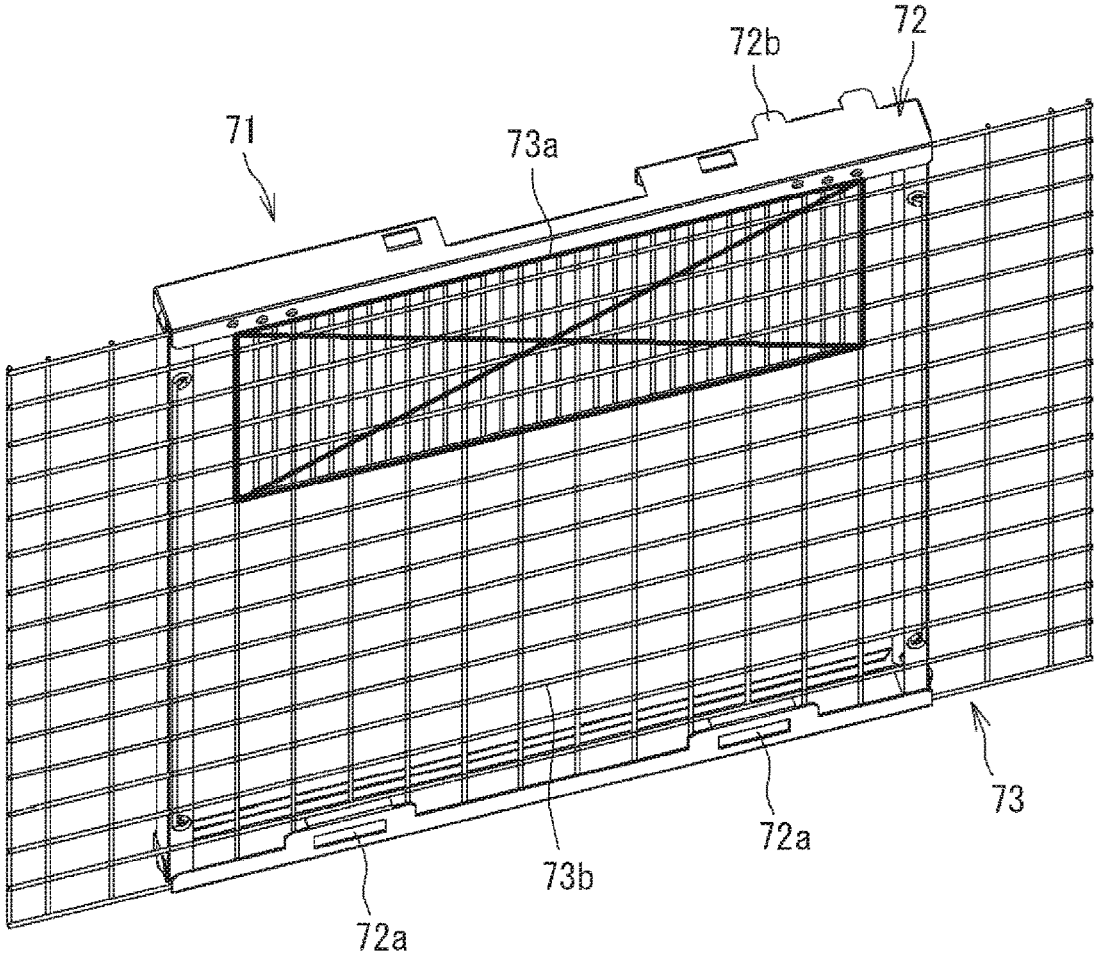
FIG. 14 is a perspective view of the protecting member (including a frame and a mesh body).

FIG. 14 is a perspective view of the protecting member (including a frame and a mesh body). FIG. 3 to FIG. 5 depict the protecting member 71 configured to inhibit entry of part of a human body (particularly a finger) into the irradiation range of ultraviolet rays in the casing 20. The protecting member 71 covers the intake port 23 to inhibit entry of a finger into the space A (see FIG. 5) from the indoor space S1 via the intake port 23. As depicted in FIG. 14, the protecting member 71 includes a frame 72 and a mesh body 73. As depicted in FIG. 3 and FIG. 4, the protecting member 71 further includes a stay 74.

As depicted in FIG. 14, the frame 72 is a member constituted by steel materials assembled into a substantially rectangular shape, and is provided with attachment holes 72*a* and a protrusion 72*b*. The protrusion 72*b* projects toward an upper surface of the frame 72 (an upper side when the frame is attached to the casing 20). The mesh body 73 is attached to a lower surface of the frame 72 (a lower side when the frame is attached to the casing 20).

As depicted in FIG. 3 and FIG. 4, the lower end portion of the second casing 22 is provided with a pair of stays 74. The protecting member 71 is attached to the casing 20 such that the stays 74 are inserted to the attachment holes 72*a* and hang the frame 72. Among the components 72 to 74 constituting the protecting member 71, the frame 72 and the mesh body 73 are detachably attached to the casing 20. The frame 72 and the mesh body 73 are swingable with respect to the casing 20 with a contact portion of the frame 72 and the stays 74 serving as a fulcrum. The protecting member 71 in the indoor unit 11 is positioned to cover the intake port 23 while the indoor space S1 is air conditioned. The protecting member 71 in the indoor unit 11 is positioned to be apart from the intake port 23 when air conditioning of the indoor space S1 is stopped and the interior of the casing 20 is maintained. The protecting member 71 is configured to be detachably attached to the casing 20.

The mesh body 73 is a member constituted by steel wires woven into a lattice shape, and includes a first region 73*a* and a second region 73*b*. The first region 73*a* depicted in FIG. 3, FIG. 4, and FIG. 14 is surrounded with a bold solid line. The first region 73*a* is disposed adjacent to the ultraviolet ray irradiator 50 in the mesh body 73. The second region 73*b* corresponds to a region other than the first region 73*a* in the mesh body 73. The second region 73*b* is disposed farther from the ultraviolet ray irradiator 50 than the first region 73*a*.

If a finger of a user (part of a human body) is inserted to the casing 20 from the protecting member 71, the finger may be irradiated with ultraviolet rays emitted from the ultraviolet ray irradiator 50 in the first region 73*a*. Even if the finger of the user (part of the human body) is inserted to the casing 20 from the protecting member 71, the finger cannot be irradiated with ultraviolet rays emitted from the ultraviolet ray irradiator 50 in the second region 73*b*. The mesh body 73 in the first region 73*a* has a first mesh size M1, and the mesh body 73 in the second region 73*b* has a second mesh size M2. The protecting member 71 according to one or more embodiments is provided with mesh (a lattice) having an oblong shape that has a short side having a size referred to as the "mesh size".

In the protector 70, the first mesh size M1 in the first region 73*a* is smaller than the second mesh size M2 in the second region 73*b*. Specifically, the first region 73*a* according to one or more embodiments includes steel wires having a wire diameter of 2 mm and aligned at a pitch of 9 mm on a short side, and has an opening of about 7 mm on the short side. That is, the first mesh size M1 in the first region 73*a* is sized not to allow insertion of a test finger having an outer diameter of φ8.5 (i.e., 8.5 mm). It is thus impossible for a user to insert a finger in a gap of the mesh in the first region 73*a*. The protecting member 71 in the indoor unit 11 can inhibit irradiation of a human body with ultraviolet rays emitted from the ultraviolet ray irradiator 50.

Meanwhile, the second region 73*b* according to one or more embodiments includes steel wires having a wire diameter of 2 mm and aligned at a pitch of 13.5 mm on a short side, and has an opening of about 11.5 mm on the short side. That is, the second mesh size M2 in the second region 73*b* is sized to allow insertion of the test finger having the outer diameter of φ8.5 (i.e., 8.5 mm). The protecting member 71 in the indoor unit 11 is reduced in weight by limiting an area of the first region 73*a*.

(Limit Switch)

Figure 15:
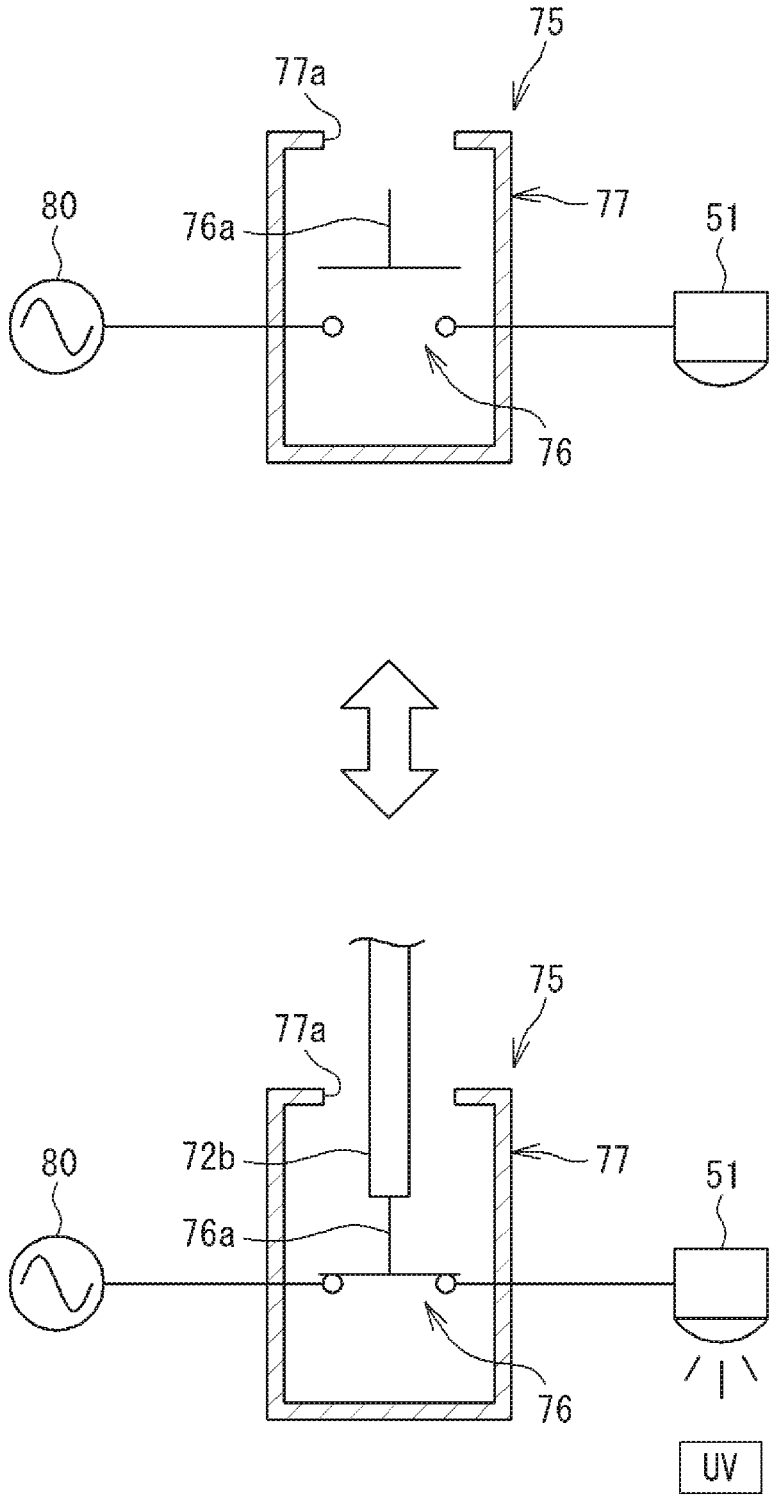
FIG. 15 is a schematic pattern view indicating behavior of the limit switch.

FIG. 15 is a schematic pattern view indicating behavior of the limit switch. As depicted in FIG. 9 and FIG. 10, the limit switch 75 includes a switch body 76 and a protecting cover 77. As depicted in FIG. 6, FIG. 7, FIG. 9, and FIG. 10, the limit switch 75 is disposed in the casing 20. The limit switch 75 is configured to inhibit irradiation of a human body with ultraviolet rays when a user detaches the protecting member 71 from the casing 20.

As depicted in FIG. 9, the protecting cover 77 is provided with an opening 77*a*. In a state where the protecting member 71 is attached at a predetermined position of the casing 20, the protrusion 72*b* (see FIG. 14) of the protecting member 71 is inserted to the protecting cover 77 via the opening 77*a*.

As depicted in FIG. 10, the switch body 76 is disposed inside the protecting cover 77. The switch body 76 includes a pressed part 76*a*. In a state where the protecting member 71 is attached at the predetermined position of the casing 20, the protrusion 72*b* (see FIG. 14) inserted to the protecting cover 77 via the opening 77*a* presses the pressed part 76*a*.

As depicted in FIG. 15, the limit switch 75 is connected to a power source circuit 80 configured to supply the light source 51 with electric power. The limit switch 75 enables supply of electric power from the power source circuit 80 to the light source 51 in a state where the pressed part 76*a* of the switch body 76 is pressed (see a lower portion in FIG. 15). The light source 51 emits ultraviolet rays UV in this case. The limit switch 75 blocks supply of electric power from the power source circuit 80 to the light source 51 in another state where the pressed part 76*a* is not pressed (see an upper portion in FIG. 15). The light source 51 does not emit ultraviolet rays UV in this case.

In the protector 70, the limit switch 75 enables ultraviolet ray irradiation by the light source 51 in the state where the protecting member 71 is attached at the predetermined position of the casing 20 (see the lower portion in FIG. 15), and the limit switch 75 disables ultraviolet ray irradiation by the light source 51 in a state where the protecting member 71 is detached from the casing 20 (see the upper portion in FIG. 15). In the indoor unit 11, the limit switch 75 inhibits irradiation of a human body with ultraviolet rays emitted from the ultraviolet ray irradiator 50 in his manner.

Regarding Different Embodiments

Figure 16:
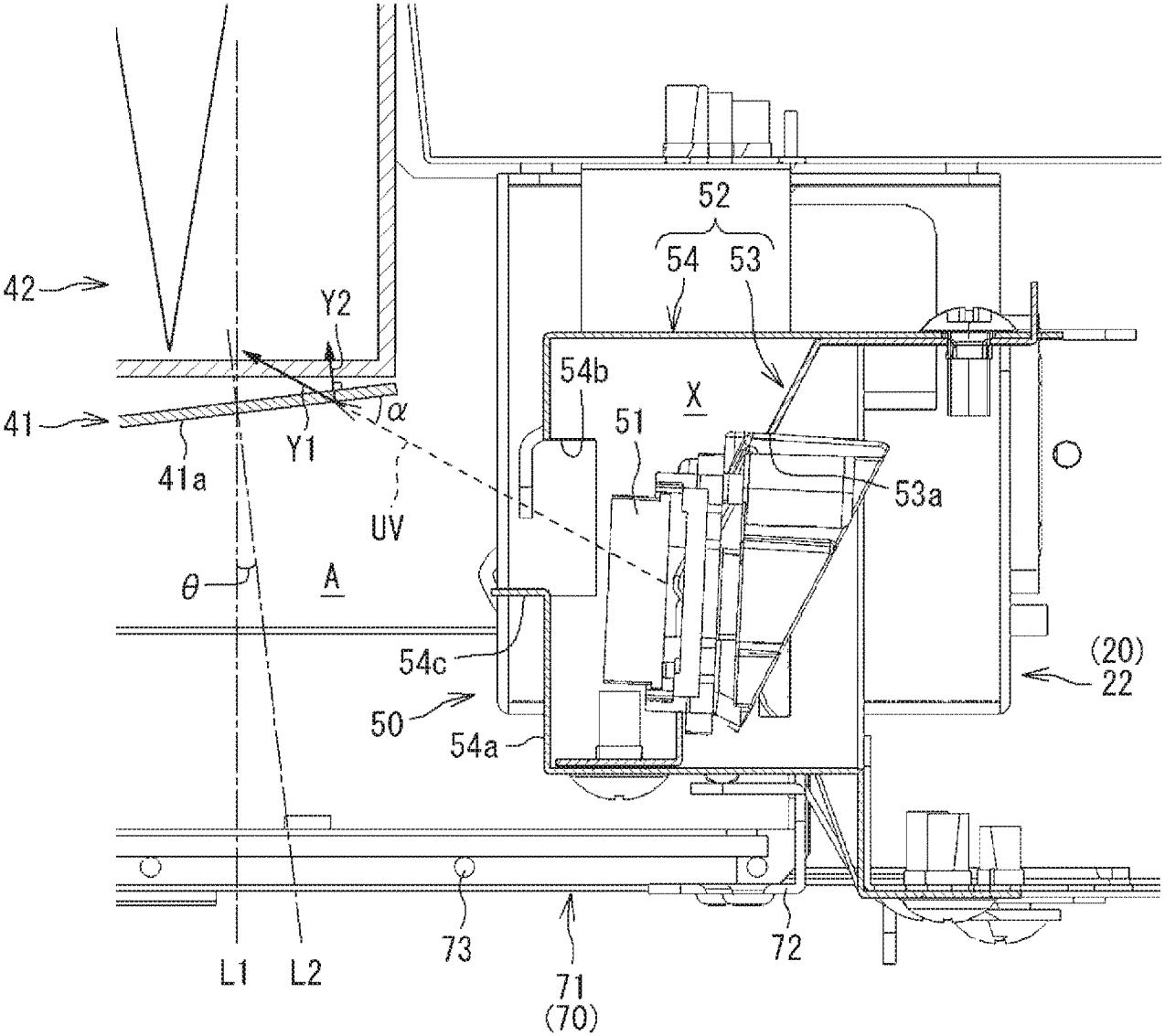
FIG. 16 is a schematic partial sectional view indicating an ultraviolet ray irradiating situation of the ultraviolet ray irradiator (in a case where the first filter is slantly disposed).

FIG. 16 is a schematic partial sectional view indicating an ultraviolet ray irradiating situation of the ultraviolet ray irradiator (in a case where the first filter is slantly disposed). In the indoor unit 11 described above, the first filter 41 is disposed to have a posture with the first surface 41*a* having a normal line directed vertically downward (see FIG. 11). The first filter 41 may alternatively be disposed such that the normal line of the first surface 41*a* is slanted from a vertical direction. In the indoor unit 11 depicted in FIG. 16, the first filter 41 is disposed such that a normal line L2 of the first surface 41*a* is slanted at an angle θ toward the light source 51 with respect to a vertical line L1. In the indoor unit 11 depicted in FIG. 16, the light source 51 irradiates the first surface 41*a* with ultraviolet rays in this state.

The cleaning capacity for the first filter 41 with use of ultraviolet rays can be evaluated by a product of irradiation intensity and irradiation time of the ultraviolet rays. In an exemplary case where the ultraviolet rays UV having irradiation intensity Y1 are applied to the first surface 41*a* at an incidence angle α, irradiation intensity Y2 of ultraviolet rays on the first surface 41*a* is obtained by multiplying the irradiation intensity Y1 by cos α (Y2=Y1 cos α).

As depicted in FIG. 16, in the indoor unit 11 according to the present disclosure, the light source 51 irradiates the first surface 41*a* of the first filter 41 in the state where the normal line L2 of the first surface 41*a* is slanted from a vertically downward portion toward the light source 51 at the angle θ. In comparison to a case where the first filter 41 is not slanted (when θ=0°), the incidence angle α of the ultraviolet rays UV to the first surface 41*a* can approach 90 degrees in this configuration. The incidence angle α of the ultraviolet rays UV to the first surface 41*a* can thus be increased in comparison to a case where the light source 51 is disposed at a position deviated from the air flow, for improvement of the irradiation intensity Y2 of ultraviolet rays to the first filter 41. The indoor unit 11 depicted in FIG. 16 can thus secure sufficient irradiation intensity of ultraviolet rays emitted from the light source 51 for cleaning of the first surface 41*a*, so as to reliably clean the first filter 41. The first filter 41 may be provided while constantly slanted at the angle θ from the casing 20, or may be configured to be slanted only upon emitting ultraviolet rays from the light source 51 with use of a mechanism (not depicted).

(Regarding Ultraviolet Ray Irradiation Timing)

The air conditioner 10 is configured to start and stop operation in accordance with operation of a remote controller (not depicted) disposed in the indoor space S1 or the like. Upon operation start of the air conditioner 10, the light source 51 in the indoor unit 11 irradiates the first surface 41*a* of the first filter 41 with ultraviolet rays for a predetermined time period. The first filter 41 can thus be cleaned each time the air conditioner starts operation while a user is unconscious of ultraviolet ray irradiation timing. Alternatively, the indoor unit 11 may execute residual operation for the predetermined time period upon operation stop of the air conditioner 10, and the light source 51 may irradiate the first surface 41*a* of the first filter 41 with ultraviolet rays during such residual operation. In this case, the first filter 41 can be cleaned upon operation stop while a user is unconscious of ultraviolet ray irradiation timing, to enable subsequent operation start with the interior of the casing 20 being clean.

(Regarding Ultraviolet Ray Irradiation Time)

The light source 51 adopted in the indoor unit 11 has a characteristic that irradiation intensity decreases as irradiation time increases. The indoor unit 11 has a function of recording irradiation time of the light source 51, and each ultraviolet ray irradiation time is increased in accordance with increase of the irradiation time. In this case, the first filter 41 can be reliably cleaned even if the indoor unit 11 is increased in total operation time and the light source 51 is decreased in irradiation intensity.

The indoor unit 11 may further restrict each irradiation time of the light source 51. This achieves inhibiting the light source 51 from ending its life before the indoor unit 11 ends its product life. The ultraviolet ray irradiator 50 can accordingly maintain a function of cleaning the first filter 41 until the indoor unit 11 ends its product life without replacement of the light source 51.

Functional Effects of Embodiments (1) The indoor unit 11 according to the embodiments described above is included in the air conditioner 10 configured to condition air in the indoor space S1, and the indoor unit 11 includes the casing 20 provided with the intake port 23 opened downward toward the indoor space S1, the indoor fan 25 configured to suck the air in the indoor space S1 into the casing 20 via the intake port 23, the first filter 41 configured to collect dust contained in the air sucked via the intake port 23, the ultraviolet ray irradiator 50 configured to irradiate the upstream side of the first filter 41 in an air flow direction with ultraviolet rays, and the blocking member 52 configured to block ultraviolet rays from the ultraviolet ray irradiator 50 toward the intake port 23.

In the indoor unit 11 thus configured, the blocking member 52 can inhibit irradiation of the indoor space S1 with the ultraviolet rays emitted from the ultraviolet ray irradiator 50. It is accordingly possible to provide the indoor unit 11 having the function of cleaning the first filter 41 with use of ultraviolet rays, for higher cleaning capacity in the casing 20 of the indoor unit 11.

(2) The indoor unit 11 according to the above embodiments further includes the protecting member 71 having a mesh shape and covering the intake port 23 at a position upstream of the first filter 41 in the air flow direction. The first mesh size M1 in the first region 73*a* positioned adjacent to the light source 51 in the protecting member 71 is smaller than the second mesh size M2 in the second region 73*b* positioned farther from the light source 51 than the first region 73*a* in the protecting member 71, and the first mesh size M1 is sized not to allow insertion of the test finger having the outer diameter of φ8.5 (i.e., 8.5 mm).

This configuration can inhibit a user from inserting a finger to the casing 20 in the first region 73*a* in the protecting member 71. This accordingly achieves inhibiting irradiation of the finger of the user with the ultraviolet rays emitted from the light source 51.

(3) In the indoor unit 11 according to the above embodiments, the protecting member 71 is detachably attached to the casing 20, and there is further provided the limit switch 75 configured to be turned ON and turned OFF to interlock with attachment and detachment of the protecting member 71. The limit switch 75 in the indoor unit 11 enables ultraviolet ray irradiation by the ultraviolet ray irradiator 50 in the case where the protecting member 71 is attached to the casing 20, and disables ultraviolet ray irradiation by the ultraviolet ray irradiator 50 in the other case where the protecting member 71 is detached from the casing 20.

Such a configuration can inhibit irradiation of a user with the ultraviolet rays emitted from the ultraviolet ray irradiator 50 when the user works with the protecting member 71 being detached.

(4) In the indoor unit 11 according to the above embodiments, the first filter 41 has an upstream surface in the air flow direction, and the upstream surface corresponds to the first surface 41*a* having the planar shape. In the indoor unit 11, the light source 51 irradiates the first surface 41*a* with ultraviolet rays.

In this case, the ultraviolet ray irradiator 50 irradiates the first surface 41*a* having the planar surface with ultraviolet rays so as to inhibit any portion irradiated with no ultraviolet rays in the first filter 41 upstream in the air flow direction. The ultraviolet rays emitted from the ultraviolet ray irradiator 50 can thus reliably clean the first filter 41.

(5) The indoor unit 11 according to the above embodiments further includes the second filter 42 configured to collect dust contained in the air sucked via the intake port 23 at a position downstream of the first filter 41 in the air flow direction. The first filter 41 in the indoor unit 11 has coarser mesh in comparison to the second filter 42.

Provision of the second filter 42 in addition to the first filter 41 in this case achieves reliable collection of dust and the like contained in the air.

(6) In the indoor unit 11 according to the above embodiments, the ultraviolet ray irradiator 50 is disposed at a position deviated from the air flow from the intake port 23 to the first filter 41.

In this case, the ultraviolet ray irradiator 50 can inhibit increase in air flow resistance of air flowing in the casing 20.

(7) In the indoor unit 11 according to the above embodiments, the ultraviolet ray irradiator 50 irradiates the first filter 41 with ultraviolet rays in the state where the normal line L2 of the first surface 41*a* is slanted at the angle θ toward the ultraviolet ray irradiator 50 from the vertical line L1.

This case achieves securing irradiation intensity of the ultraviolet rays applied to the first surface 41*a* from the ultraviolet ray irradiator 50 in the configuration in which the ultraviolet ray irradiator 50 is disposed at a position deviated from the air flow. The ultraviolet rays emitted from the ultraviolet ray irradiator 50 can thus reliably clean the first filter 41.

(8) The indoor unit 11 according to the above embodiments further includes the activated species generator 60 configured to generate activated species at a position upstream of the first filter 41 in the air flow direction.

In this case, provision of the light source 51 and the activated species generator 60 leads to higher cleaning capacity in the casing 20.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 air conditioner
11 indoor unit
20 casing
23 intake port
25 indoor fan (fan)
41 first filter (first collecting member)
41*a* first surface
42 second filter (second collecting member)
50 ultraviolet ray irradiator
51 light source
52 blocking member
60 activated species generator (generator)
71 protecting member
73*a* first region
73*b* second region
75 limit switch (switch)
S1 indoor space
M1 first mesh size
M2 second mesh size

What is claimed is:

1. An indoor unit in an air conditioner configured to condition air in an indoor space, the indoor unit comprising:

a casing that comprises an intake port opened downward toward the indoor space;

a fan configured to suck air in the indoor space into the casing via the intake port;

a first dust filter disposed adjacent to the intake port and that collects dust contained in the air sucked via the intake port;

a second dust filter that:

collects dust contained in the air sucked via the intake port at a position downstream of the first dust filter in an air flow direction, and has a finer mesh than the first dust filter;

a light source configured to irradiate an upstream side of the first dust filter in the air flow direction with ultraviolet rays and disposed at a position where the light source does not overlap either of the intake port and the first dust filter when viewed along the air flow direction; and a shield configured to block the ultraviolet rays from the light source toward the intake port, wherein the first dust filter has a first surface having a planar surface as an upstream surface in the air flow direction, and the light source irradiates the first surface with the ultraviolet rays.

2. The indoor unit in the air conditioner according to claim 1, wherein the light source irradiates the first dust filter with the ultraviolet rays in a state where a line perpendicular to the first surface is slanted toward the light source with respect to vertically downward.

* * * * *